US005803721A

United States Patent [19]

Lee

[11] Patent Number: 5,803,721

[45] Date of Patent: Sep. 8, 1998

[54] CLEAN ROOM FAN UNIT

[75] Inventor: Soonku Lee, Seoul, Rep. of Korea

[73] Assignee: Enviroflex, Inc., Anaheim, Calif.

[21] Appl. No.: 741,189

[22] Filed: Oct. 29, 1996

[51] Int. Cl.[6] ..... F04B 17/00

[52] U.S. Cl. ..... 417/423.14; 417/423.15; 417/424.2; 415/119; 415/211.2; 416/185; 416/223 B

[58] Field of Search ..... 417/423.14, 423.1, 417/423.15, 424.2; 415/119, 211.2; 416/185, 187, 223 B

[56] References Cited

U.S. PATENT DOCUMENTS

| | | | |
|---|---|---|---|
| 2,444,966 | 7/1948 | Troller | 417/423.14 |
| 2,591,408 | 4/1952 | Crankshaw . | |
| 2,704,504 | 3/1955 | Wilkening . | |
| 3,251,289 | 5/1966 | Mariner . | |
| 3,672,773 | 6/1972 | Moller . | |
| 3,688,477 | 9/1972 | Coward, Jr. . | |
| 3,776,121 | 12/1973 | Truhan . | |
| 3,780,503 | 12/1973 | Smith . | |
| 3,799,703 | 3/1974 | Paine et al. | 415/119 |
| 3,824,909 | 7/1974 | Horneff et al. . | |
| 4,023,472 | 5/1977 | Grunder et al. . | |
| 4,319,899 | 3/1982 | Marsh . | |
| 5,167,681 | 12/1992 | O'Keefe et al. | 55/385.2 |

FOREIGN PATENT DOCUMENTS

| | | | |
|---|---|---|---|
| 615 359 | 7/1935 | Germany . | |
| 21 38 985 | 2/1973 | Germany . | |
| 78 25 017 | 2/1979 | Germany . | |
| 29 25 845 | 1/1980 | Germany . | |
| SHO 58-210821 | 12/1983 | Japan . | |
| 3267600 A | 11/1991 | Japan | 415/119 |
| 509 548 | 8/1971 | Switzerland . | |
| 308333 | 4/1929 | United Kingdom . | |

*Primary Examiner*—Timothy Thorpe
*Assistant Examiner*—Cheryl J. Tyler
*Attorney, Agent, or Firm*—Knobbe, Martens, Olson & Bear, LLP

[57] ABSTRACT

A clean room fan unit is used to provide a continuous flow of air to a clean room, where the air flow is substantially free of undesired impurities. The fan unit includes a rectangular housing that defines a cavity. A fan unit is located inside the cavity for drawing air into the housing and into the clean room. The fan has blades with pitch angles selected to provide a particular flow path and flow rate that reduces the amount of noise generated by the fan unit while increasing the efficiency of the fan unit. A perforated plate is situated within the air flow path in the fan unit housing such that the perforations diffuse the air flow before it passes through a filter and exits the housing. The uniform air flow provided by the perforated plate produces a reduced noise level.

32 Claims, 10 Drawing Sheets

CLEAN ROOM FAN UNIT

FIELD OF THE INVENTION

The present invention relates to a fan unit used to produce a filtered flow of air to a clean room.

BACKGROUND OF THE INVENTION

Clean rooms are rooms having clean air environments where the air within the room is substantially free of particles larger than a specified size and greater than a specified quantity. Clean rooms are often used for work environments involving sensitive materials or processes that are highly sensitive to impurities in the air such as semiconductor fabrication. Because the work that is conducted within clean rooms is often of a delicate nature, unnecessary noise may distract or annoy personnel within the room.

Generally, a fan unit is used to help maintain the air within the clean room in a purified state. The fan is often contained in a housing that is mounted in the ceiling of the clean room. The fan draws air from an outside environment and passes it through a filter that is located along a flow path in the fan unit. The filter removes impurities and contaminants from the air as it flows through the fan unit. After passing through the filter, the air is propelled into the clean room, and exits through vents along the floor. In this fashion, the clean room fan provides a continuous supply of substantially purified air into the clean room with the flow of air through the room carrying contaminants out of the room.

Unfortunately, prior fan units often generate a high level of noise when they are being operated. The noise generated by a clean room fan may be caused by a variety of factors. As the air flows into or through the housing, it often flows in a turbulent manner which generally causes a higher noise level than air that flows in a laminar state. The fan unit's housing can amplify this noise. Vibration of the fan and motor units caused by the turbulent air flow may cause additional noise. Further, the rotation of the fan and the operation of the fan motor combine to generate noise.

Another disadvantage associated with prior fan units is that they do not perform efficiently. Fan units are typically designed by combining a standard available motor with a standard available fan. By using off-the-shelf components, the initial cost of the fan unit can be reduced. But using off-the-shelf components can lead to slight unbalances, undesirable resonances that amplify noise, and inefficient movement of air.

In view of the foregoing drawbacks, there is a need for a clean air fan unit where the fan unit generates lower levels of noise within the clean room. Moreover, there is a need for a clean room fan unit that eliminates the drawbacks of fan units made from combining standard off-the-shelf components.

SUMMARY OF THE INVENTION

In one aspect of the invention, a clean room fan unit includes a rectangular housing that has a length and a width and that defines a rectangular cavity. The housing has side walls and a top wall. An aperture extends through the top wall and is surrounded by a bell mouth on the top wall. A fan, which is configured to rotate about an axis, is located within the housing. A series of fan blades are arranged around a periphery of the fan. The fan blades are oriented at a desired pitch angle so that they define a series of slots between the fan blades that are configured to release air from the fan into the cavity in a direction substantially perpendicular to the axis. A fan motor is configured to drive the fan so that the fan rotates about the axis. A plate that is located within the housing supports the fan motor and has a series of perforations extending through the plate for the flow of air through the plate in a laminar state. A filter is located in the housing for removing contaminants from the flow of air. The filter is positioned adjacent the plate and extends across the cavity so that the filter defines a hollow plenum with the plate. At least one baffle is positioned within the cavity adjacent each side wall. The baffles are configured to absorb sound that is generated by the fan unit.

The rotation of the fan about the vertical axis causes air to flow through the aperture into the fan. The air then flows out of the slots in the fan and into the cavity in a direction perpendicular to the axis. The air subsequently flows through the perforations in the plate and through the filter for cleaning and then into the room.

In another aspect of the invention, a fan unit for releasing clean air into a clean room is disclosed. The fan unit consists of a housing defining a cavity and having an aperture in communication with the cavity. A fan is located within the housing for drawing air through the aperture and into the fan when the fan rotates. The fan has a series of blades oriented at a selected pitch angle for releasing air from the fan into the cavity in a direction perpendicular to the fan's axis of rotation and at a desired flow rate. A perforated plate is positioned within the housing for diffusing and directing the flow of air after the air exits the fan. The perforated plate causes air to flow in a direction parallel to the axis of rotation of the fan. A filter is located within the housing for removing impurities from the air after the air passes through the perforated plate. At least one baffle is positioned within the housing for quieting the operation of the fan unit. The baffles have a planar shape and are oriented substantially parallel to the axis of rotation of the fan.

There is thus advantageously provided a clean room fan unit having a rectangular housing with two substantially parallel side walls joined to two substantially parallel end walls and further having the side and end walls joined to a rectangular top wall to define a rectangular cavity. The top wall has an exterior surface and interior surface with a generally circular aperture extending through the top wall and located at the center of the top wall. A bell mouth surrounds the aperture in the top wall and is configured to cause air flowing through the aperture to enter the aperture in a laminar flow. A fan is located below the aperture and inside the rectangular cavity and in fluid communication with the bell mouth. The fan rotates about a longitudinal axis that passes through the center of the aperture to take incoming air from the bell mouth and expel the air into the cavity in a plane generally perpendicular to the rotational axis. The fan has a plurality of fan blades mounted between a top and bottom support structure. The blades have an airfoil cross-sectional shape and mounted a uniform distance from the rotational axis and orientated at a pitch angle selected to move air efficiently at a predetermined rotational speed of the fan. A fan motor is mounted to a motor mounting plate located inside the cavity, with the motor being drivingly connected to the fan to rotate the fan about the axis at a predetermined speed. An air guide plate is located below the motor and extends between the side walls. The air guide plate has a longitudinal center line and edges and being angled along the center line so the center line of the plate is further from the motor than the edges. At least one of the air guide or motor mounting plate blocks air in the cavity from flowing along the motor toward the bell mouth. A perforated plate is located below the air guide plate. The perforated plate is connected to the side and end walls to enclose the cavity so the fan can create a high pressure within the cavity and force air through the perforated plate. A filter is mounted below and spaced apart from the perforated plate to define a plenum above the filter to allow air flowing through the perforated plate to be distributed below the entire surface of the perforated plate.

These and other features of the invention will now be described with reference to the drawings of preferred embodiments of the clean room fan unit. The illustrated embodiments of the clean room fan unit are intended to illustrate, but not to limit the invention.

DETAILED DESCRIPTION OF THE PREFERRED EMBODIMENT

Figure 1:
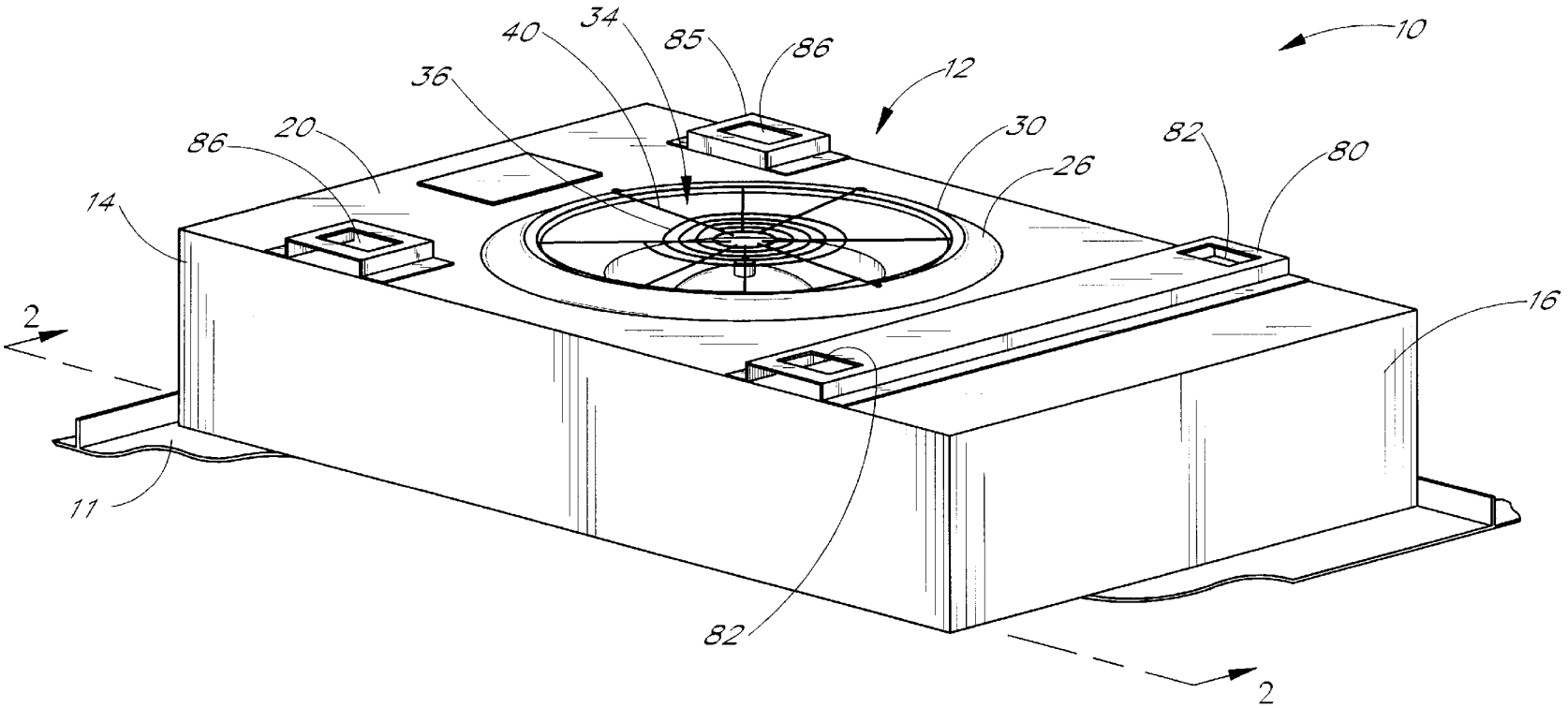
FIG. 1 is a perspective view of the clean room fan unit of the present invention mounted on a ceiling.
Figure 2:
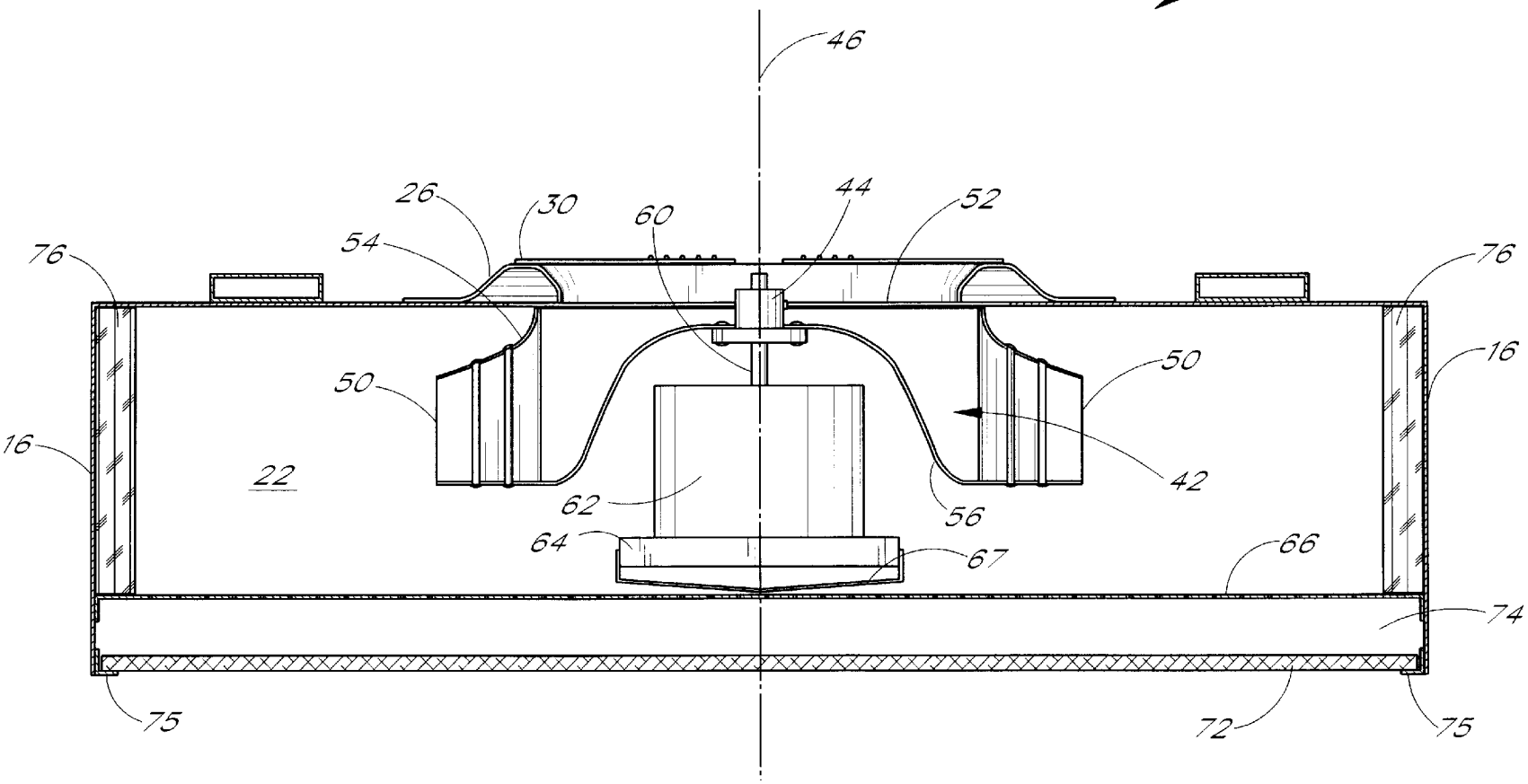
FIG. 2 is a cross-sectional side view of the clean room fan unit of FIG. 1 taken along line 2—2 of FIG. 1.

FIGS. 1 and 2 show a clean room fan unit 10 installed in a ceiling 11 which is generally parallel to the horizontal floor of the clean room. As used herein, upper and lower, above or below, and top and bottom directions refers to directions or relative positions along a vertical axis orthogonal to the ceiling 11 which is generally parallel to the ground. The fan unit 10 can be used in soft wall clean rooms, as well as clean booths or clean benches. The fan units 10 are typically installed in a ceiling 11 that uses an inverted "T" bar construction to support ceiling panels and equipment such as the fan 10. The fan unit 10 includes a rectangular-shaped housing 12 with two opposed and substantially flat side walls 14 and two opposed and substantially flat end walls 16 that are oriented at right angles to the side walls 14. The housing 12 also includes a top wall 20 that defines a rectangular-shaped cavity 22 that is enclosed by the housing 12. Preferably the walls 14, 16 are formed from several strips of metal joined into the rectangular shape and riveted or welded together. The walls 14, 16 are about 10–11 inches (25–28 cm) high, with sides 14 being about 48 inches (120 cm) long, and ends 16 about two feet wide and in particular about 23 inches (58 cm) wide.

Figure 6:
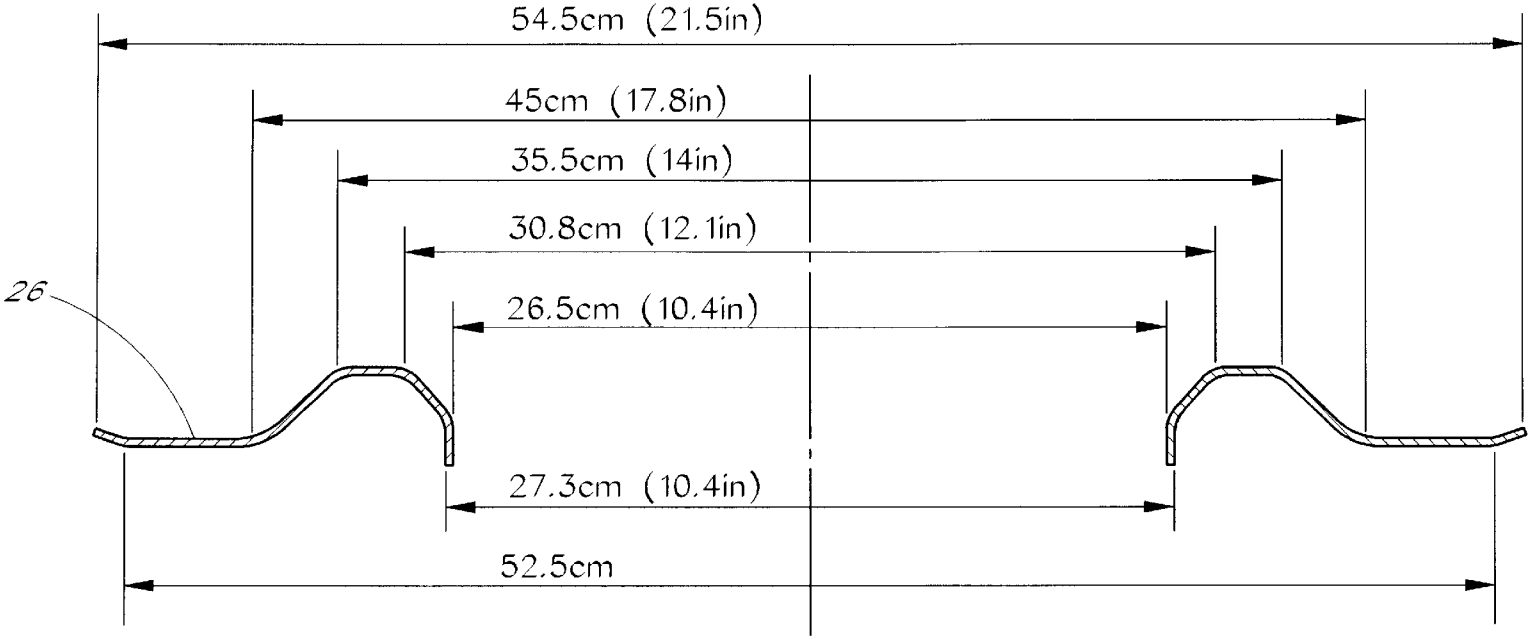
FIG. 6 is a cross-sectional side view of a bell mouth used with the clean room fan unit of the present invention.
Figure 7:
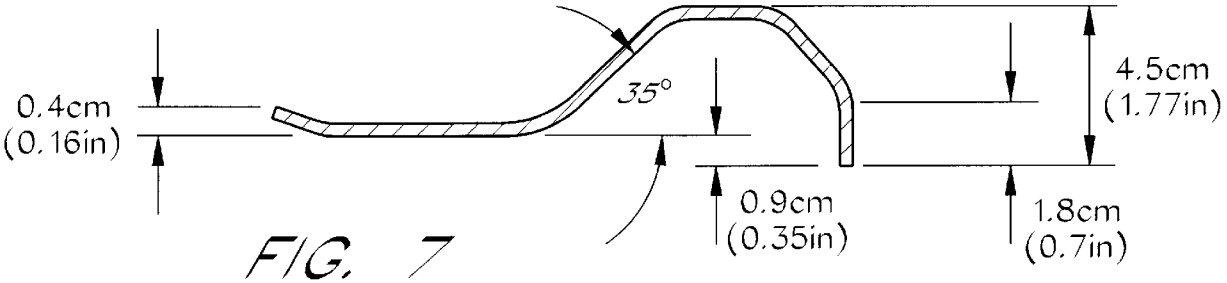
FIG. 7 is a cross-sectional side view of a portion of the bell mouth illustrated in FIG. 5.

A circular bell mouth 26 is located on the top wall 20. The bell mouth 26 surrounds a circular aperture 30 about 17 inches (43 cm) in diameter that extends through the top wall 20 and opens into the cavity 22. The bell mouth 26 has a shape that slopes outward from the top wall 20 and then descends toward the top wall at a steeper slope around the aperture 30. Referring to FIGS. 6 and 7, the cross sectional shape of the bell mouth 26 is shown in more detail as its specific shape is configured to allow air entering the bell mouth 26 to maintain a laminar air flow, and to reduce, and preferably eliminate, turbulent air flow through the bell mouth. The bell mouth 26 is formed from sheet metal and fastened to the top wall 20 of the housing 12 by spot welding, rivets, or threaded fasteners such as screws, rivets or other suitable attaching means. The aperture 30 is preferably located at the center of the top wall 20.

A wire grill 34 extends over the aperture 30. The wire grill 34 is circular and has a diameter that is substantially the same as the diameter of the aperture 30. The grill 34 is placed over the aperture 30 so that the grill 34 is supported by the bell mouth 26. The grill 34 preferably includes a series of circles formed from wires with the circles 36 concentrically arranged within one another. Alternatively, the circular wires 36 could be replaced by a single wire that spirals to form a series of circles. In any event, the circles 36 are connected by a series of radial wires 40 that extend radially outward from the center point of the aperture 30 and maintain the grill 34 in a planar shape.

Figure 3:
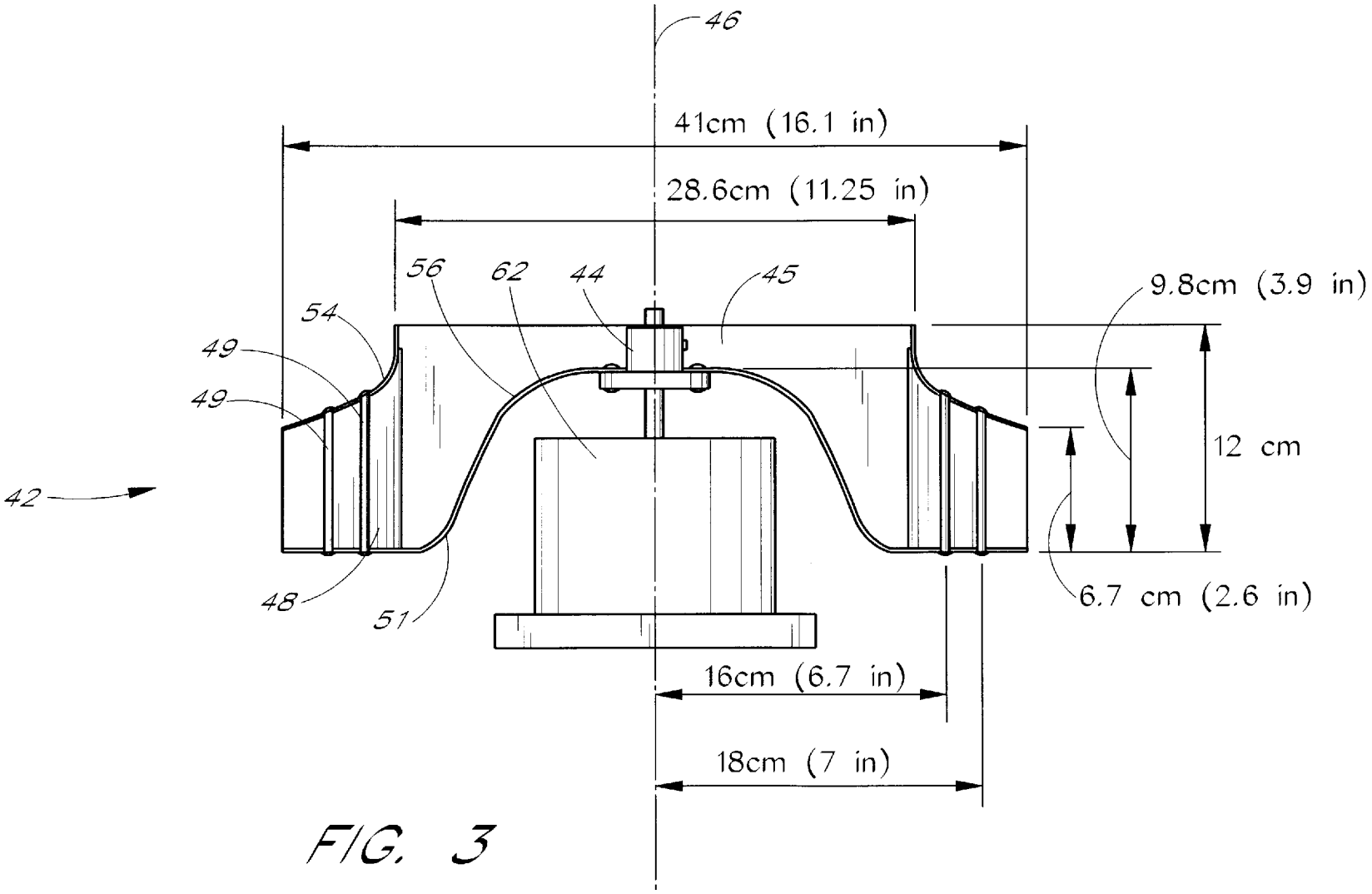
FIG. 3 is a side view of a fan and motor that are used with the clean room fan unit illustrated in FIG. 1.
Figure 8:
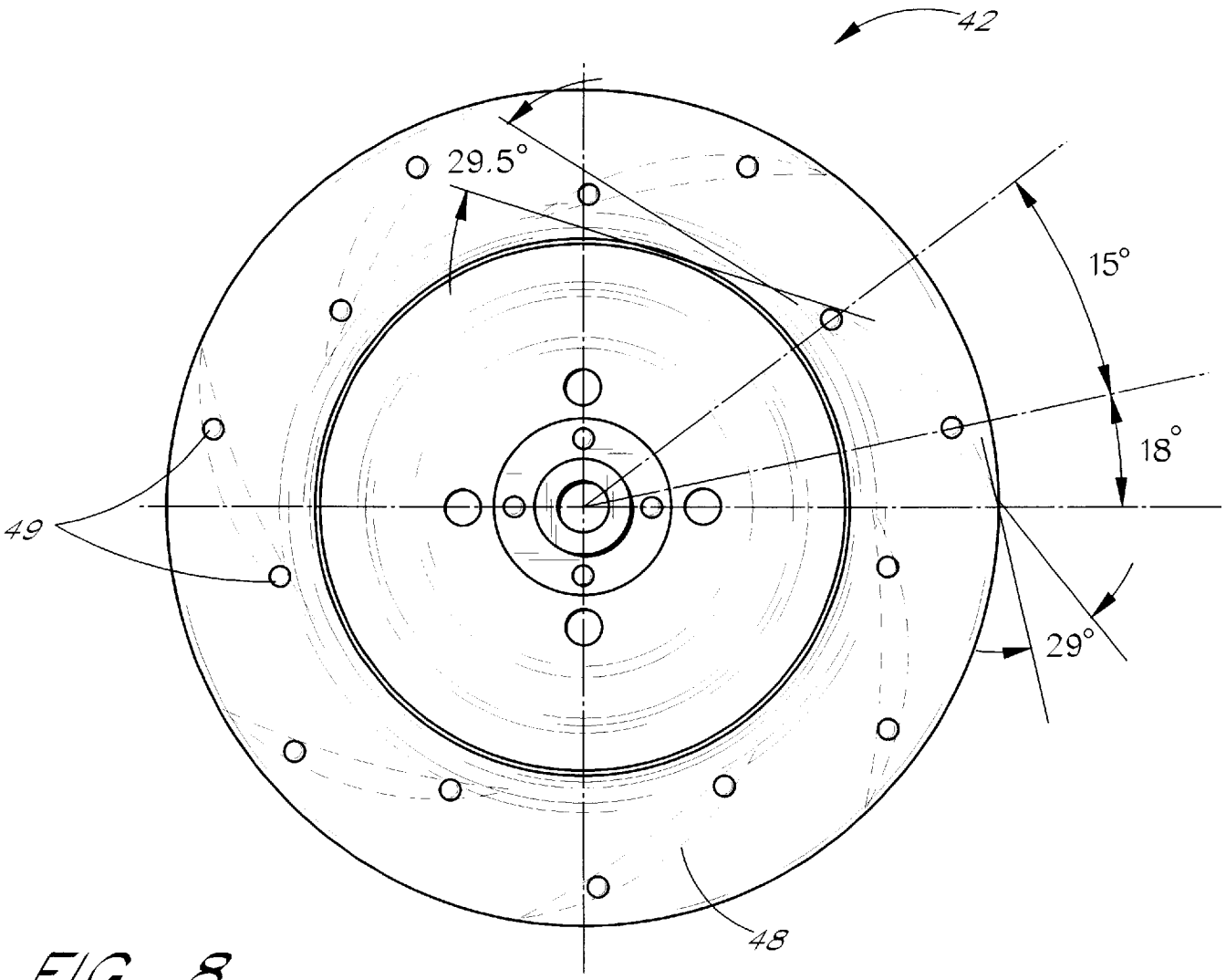
FIG. 8 is a top plan view of the fan illustrated in FIG. 3.

Referring to FIGS. 2, 3 and 8, a fan 42 is located within the cavity 22 below the aperture 30. The fan 42 is mounted at its center on a hub 44 that rotates about an axis 46, preferably in a counter-clockwise direction. If the fan 42 is mounted in a ceiling, the axis 46 would normally be vertical, or perpendicular to the floor. The fan 42 is a squirrel cage type of fan having a bell-shape. The fan 42 has an outer diameter of about 16 inches (41 cm) leaving a distance of about 3.5 inches (9 cm) between the periphery of the fan 42 and each adjacent side 14.

The top edge 52 of the fan lies adjacent the aperture 30 in the plane of the top 20. The top edge 52 of the fan 42 is flat and defines a circular air opening 45 that corresponds in size to, and communicates with, the aperture 30 in the top wall 20 of the housing 12. The air opening 45 thus has a diameter of about 11 inches (28 cm), and is configured to receive air through the aperture 30 when the fan 42 spins. The fan 42 comprises an upper curved annular surface 54, a lower annular surface 56, with fan blades 48 interposed between surfaces 54, 56. The fan blades are mounted on two mounting members 49 (FIG. 8) that extend between surfaces 54, 56. The surface 54 of the fan 42 slopes downward, away from the top edge 52 and then flares smoothly and radially outward distal of the top edge 52, ending at a circular outer periphery 50. The surface 56 has a flat, disc shaped outer flange 51 with an outer diameter 50, and an inner diameter smaller than that of apertures 30 and 45. The surface 56 curves radially inward and upward toward top 20 to joint cylindrical hub 44 aligned to rotate about vertical fan axis 46. The concave surface 56 and side surface 54 of the fan together define the interior of the fan, which is hollow and communicates with the air opening 45 to allows the passage of air therethrough and into the fan.

Referring to FIGS. 3 and 8, a series of fan blades 48 are evenly spaced around the circumference 50 of the fan 42. The blades 48 have an air foil cross-sectional shape as best seen in FIG. 8. The blades 48 are generally aligned with tangents to a circle centered about rotational axis 46 of the fan 42. The specific alignment is shown in FIG. 8.

Figure 11:
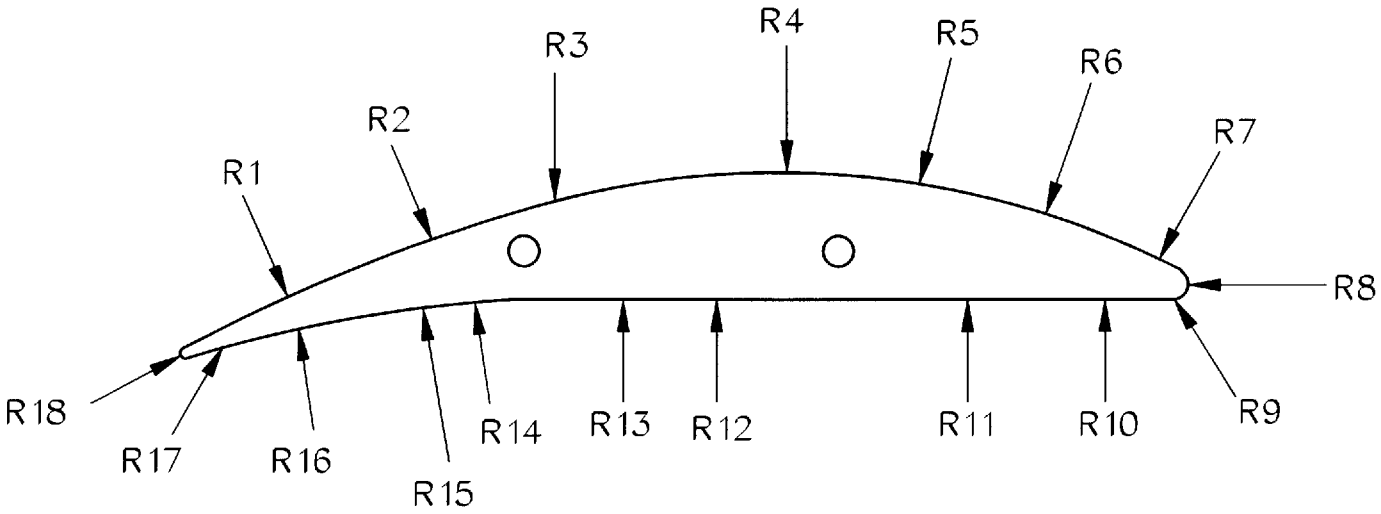
FIG. 11 is a side view of a fan blade of the fan illustrated in FIG. 3.

A single fan blade 48 is shown in FIG. 11. The shape of the fan blade 48 is defined with reference to a series of points R1 through R18 that are located along the surface of the fan blade 48. The points R1 through R18 are each defined with respect to a radius length, a pair of center point coordinates, and an angle range. Table 1 contains the corresponding values for each of the points R1 through R18.

TABLE 1

| | RADIUS | CENTER POINT | ANGLE RANGE |
|---|---|---|---|
| R1 | 224.2325 | (58.4495, −209.3422) | 110–119 |
| R2 | 175.896 | (40.21, −164.551) | 105–110 |
| R3 | 238.1476 | (56.5111, −224.6310) | 99–105 |
| R4 | 143.0341 | (40.7311, −130.8280) | 87–99 |
| R5 | 128.6797 | (46.0464, −116.0255) | 78–89 |
| R6 | 121.6896 | (46.3262, −109.5498) | 62–78 |
| R7 | 32.3852 | (87.5446, −30.3225) | 62–64 |
| R8 | 2.4188 | (102.641, −4.4332) | 334–57 |
| R9 | 1.8001 | (103.1461, −4.2206) | 259–338 |
| R10 | 948.8926 | (35.7355, 942.1544) | 270–271 |
| R11 | 2394.1191 | (37.1689, 2366.9979) | 270–271 |
| R12 | 2414.4014 | (42.854, 2407.2811) | 269–270 |
| R13 | 410.2284 | (11.5396, −417.1427) | 89–92 |
| R14 | 180.0385 | (6.1684, −187.0018) | 87–99 |
| R15 | 194.7693 | (5.744, −201.8248) | 95–101 |
| R16 | 279.5121 | (22.2456, −284.9485) | 101–102 |
| R17 | 281.5475 | (25.5392, −286.3209) | 102–106 |
| R18 | 0.8127 | (−50.9657, −14.5227) | 106–286 |

The fan blades 48 define a series of slots 49 between each of the fan blades. The slots 49 communicate with the hollow interior of the fan 42 so that air may flow out of the fan through the slots 49. The number of fan blades 48 that are arranged around the periphery 50 of the fan 42 is optimized to produce a desired air flow rate. Moreover, the fan blades 48 are set at a desired pitch angle to optimize the flow rate and deliver an air flow in a desired direction relative to the fan 42.

The fan blades 48 have a pitch angle and configuration such that when the fan spins, air flows out of the slots 49 in a direction away from the vertical axis 46. Hence, the air enters generally parallel to axis 46 and exits in a plane orthogonal to that axis. The air thus flows out of the fan 42 so that it travels toward the side and end walls 14 and 16.

The fan hub 44 is mounted to a first end of a drive shaft 60. The drive shaft 60 is oriented along the fan rotational axis 46 and rotates about that axis 46. The opposing or second end of the drive shaft 60 is drivingly connected to a fan motor 62 that is mounted below the fan 42 so that the fan 42 is cantilevered off the motor 62. Referring to FIG. 2, the fan motor 62 has a cylindrical shape and is positioned so that the fan motor 62 is partially shrouded by the concave surface 56 of the fan 42. In operation, the fan motor 62 causes the drive shaft 60 to rotate about the axis 46. The rotation of the drive shaft 60 causes the fan hub 44 and fan 42 to also rotate and draw air into the fan 42 through the aperture 30, as described below.

Figure 5:
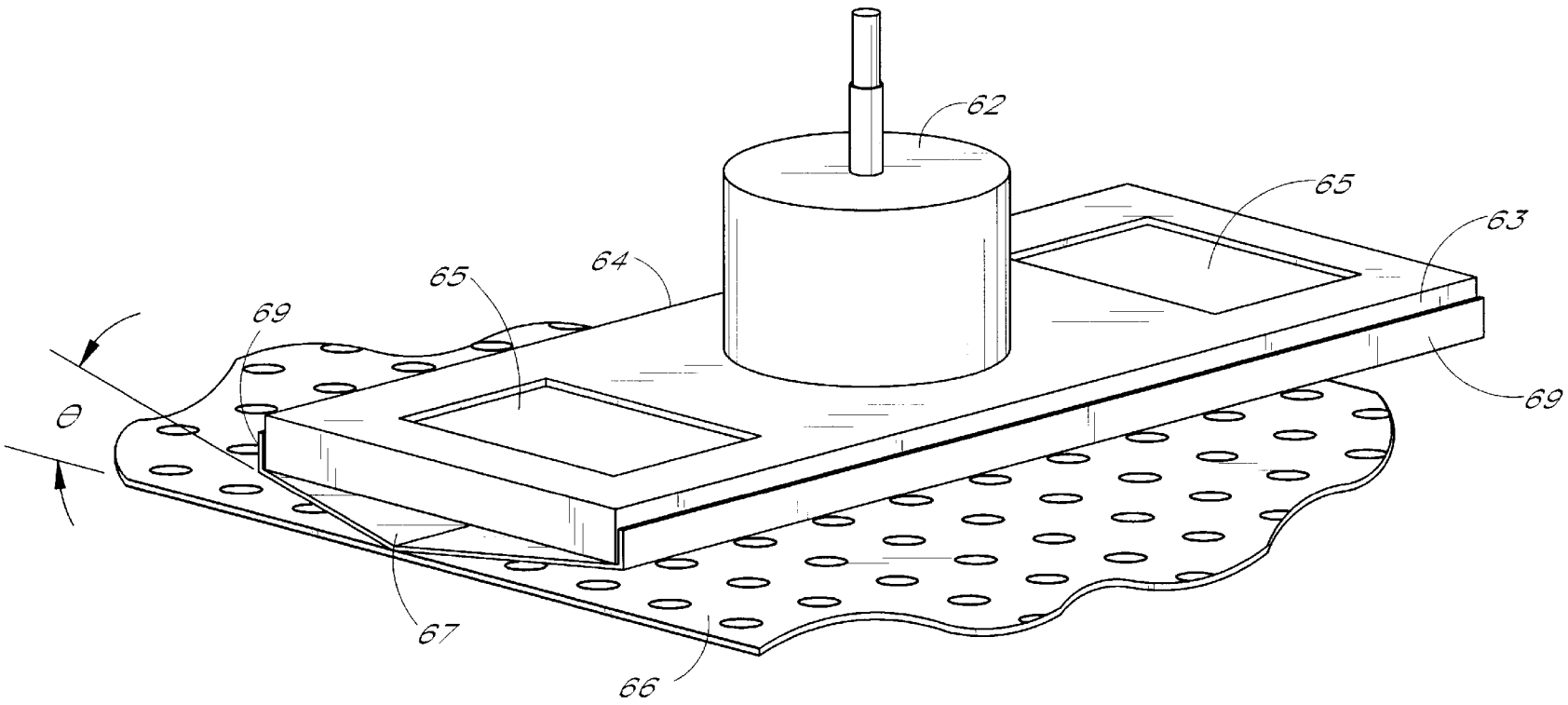
FIG. 5 is an isolated perspective view of a fan motor and motor support plate used in the fan unit of the present invention.

Referring to FIGS. 2 and 5, a motor mounting bracket is mounted to opposing side walls 12 to support the fan motor 62. Mounting the motor off the side walls 12 reduces vibration and noise generation. The mounting bracket preferably comprises a support plate 64 that is generally parallel to the top wall 20 of the housing 12 and lies substantially near an end of the housing 12 distal of the top wall 20 so that the fan motor 62 is interposed between the support plate 64 and the top wall 20. Preferably, the motor support plate 64 comprises a rectangular strip of metal connected at each end to one of the sides walls 14. The motor support plate 64 preferably has the sides of the metal strip bent or formed into a flange 63 to stiffen the support plate 66. Advantageously, the support plate 64 has apertures such as rectangular holes 65 located between the motor and the ends of the support plate 64. The support plate 64 is mounted within the cavity 22 by attaching it directly to the side walls 14, by spot welding, rivets, threaded fasteners or other suitable means.

A generally rectangular air guide plate 67 is located below the motor support plate 64, and extends between, and is connected to, opposing sides 14 by welding, rivets, threaded fasteners or other suitable fastening means. The air guide plate 67 has flanges 69 along the length of its edges and these flanges 69 are advantageously fastened to the flanges 63 on the motor support plate to stiffen and strengthen the motor support plate 66. The air guide plate 67 also has a slight "v" shape in cross section such that a line down the longitudinal center of the plate 67 is further away from the motor 62 than the edges of the plate adjacent flanges 69. The angle of the bend θ (FIG. 5) in the plate 67 is advantageously small, about 5–9 degrees in order to reduce the height of the fan unit, and is preferably about 7 degrees, although larger angles could be used. Advantageously, at least one of the air guide 67 or motor mounting plate 64 blocks air in the cavity 22 from flowing along the motor toward the rotational axis 46 of the fan 42.

Figure 4:
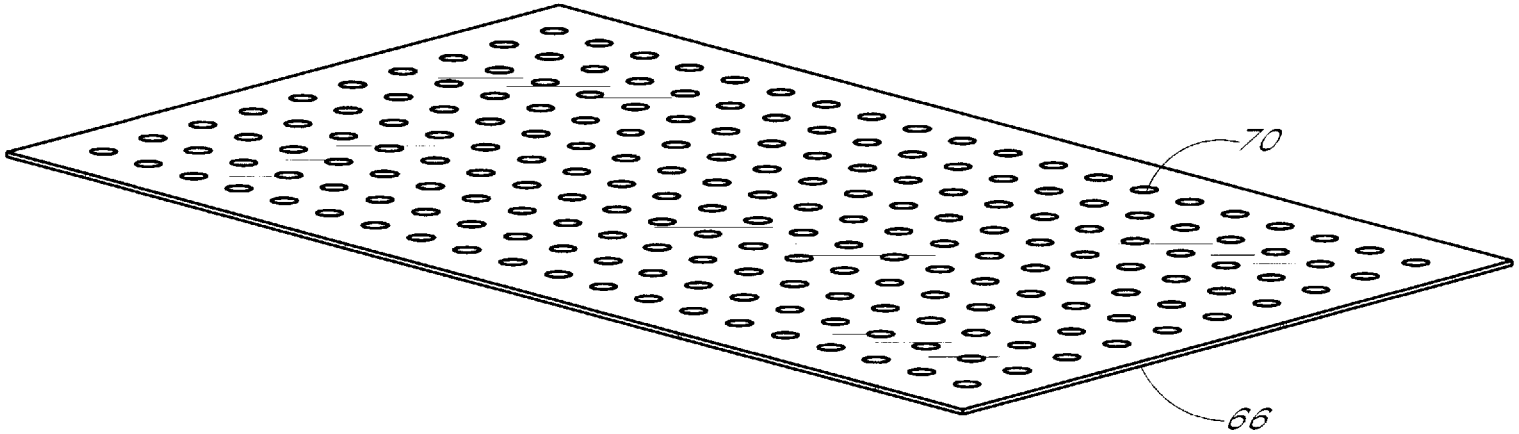
FIG. 4 is a perspective view of a perforated plate that is used with the clean room fan unit of the present invention.

Referring to FIGS. 2,4 and 5, a perforated plate 66 is positioned below the air guide plate 67 and the motor support plate 64 and is substantially parallel to top plate 20. The perforated plate 66 may be fastened to one or more of the side and end walls 14, 16 by rivets, spot welding or threaded fasteners. Alternatively, the perforated plate 66 may be mounted to brackets on one or more of the side walls 14 and end walls 16. Advantageously the perforated plate 66 covers the entire area defined by the walls 14, 16. Preferably, the air guide plate 67 does not contact the perforated plate 66 in order to minimize any vibrations that could be caused by such contact. In an alternate embodiment, the air guide plate 67 is immediately adjacent to, or abuts the perforated plate 66 and divides the cavity 22 into two substantially equal portions on opposing sides of a plane through the rotational axis 46.

A series of perforations 70 extend through the perforated plate 66. The perforations 70 are configured to allow air to flow through the plate 66. The perforations 70 advantageously function to diffuse any air flow that passes through the plate 66, as described in detail below. Furthermore, the perforations are arranged so that they advantageously cause air to flow through the plate in a laminar state. Further, the plate 66 helps isolate the air below the plate 66 from the turbulence and pressure variations in cavity 22. In FIG. 4, each of the perforations 70 have a circular shape about ⅛ inch in diameter and combine to comprise about 30% of the area of plate 66. It will be appreciated that the perforations 70 could define any wide variety of shapes that are configured to diffuse the flow of air. For instance, the perforations 70 could also have a slotted or oblong shape. Moreover, the size and shape of each the perforations 70 on the plate 66 could be varied to produce various flows through the plate 66 at different parts of the plate 66.

Either a HEPA or ULPA filter 72 is located below the perforated plate 66, distal of the top wall 20. The filter 72 lies parallel to the perforated plate 66 but is spaced apart from the perforated plate 66. A plenum 74 is defined by the space that lies between the filter 72 and the perforated plate 66 such that the plenum chamber further assists laminar flow and distribution of the air over the entire surface of the filter 72. Preferably, the filter 72 extends completely across the cavity 22 so that any air in the plenum 74 must pass through the filter 72 in order to exit the housing 12. The filter 72 is mounted on guide rails 75 having an "L" shaped cross-section with one portion extending with the rails 75 guiding the insertion and removal from the side and end walls 14 and 16 into the cavity 22. The HEPA filter 72 lies on the guide rails 75 so it can be easily replaced when needed. This is done by removing the filter 72 from the guide rails 75 and installing a new filter 72 on top of the guide rails 75. One surface of the filter 72 faces the perforated plate 66 and fan 42, while the other surface faces, and opens into, the clean room.

Referring to FIG. 2, baffles 76 are positioned within the cavity 22 along each of the end walls 16 of the housing 12. The baffles 76 may also be attached to side walls 14. The baffles 76 have flat, planar shapes although other shapes and types of noise baffles may be used. The baffles 76 have dimensions that correspond to whichever side or end wall 14 or 16 the baffles 76 are mounted so that the entire interior surface of the walls 14 or 16 are covered by the baffles 76. Preferably, the baffles 76 are constructed of a material that absorbs sound. During operation of the fan, the baffles 76 function to reduce the noise generated by the fan 42 and the fan motor 62, as well as the noise generated by the air flow within the housing 12.

Referring to FIG. 1, an elongated walking plate 80 is fastened to the top wall 20 of the housing 12 between the bell mouth 26 and the side 16. The elongated walking plate 80 comprises a rectangular sheet metal tube that extends the distance between the side walls 14 of the housing 12. Walking plate 80 is substantially parallel to end 16, but spaced about six inches (6 cm) from the adjacent end wall 16. The walking plate 80 is about 1 inch (2.5 cm) high and about 4 inches (10 cm) wide. The plate 80 provides a strengthened and stiffened location designed to allow a person to step or walk on the plate when the fan filter unit 10 is installed in a ceiling. The plate 80 is preferably connected to top 20 by rivets, welding, or threaded fasteners. Rectangular holes 82 are formed in each of the opposite ends of the elongated walking plate 80 to allow for hand holds to lift the fan filter unit 10.

Two small walking plates 85 are also located on the top wall 20 adjacent each side wall 14, and on the end opposite elongated walking plate 80. Each of the small walking plates 85 have a rectangular, tubular construction with open ends. The plates 85 are about one inch high (25 cm), four inches (10 cm) wide and five inches (12 cm) long. The plates 85 provide local stiffened and strengthened areas so a person can step on them when the fan unit is installed in a ceiling 11. The plates 85 also have rectangular holes 86 at the center of the plates 85 to allow for hand holds to lift the fan unit 10.

A terminal block box 90 is located on the top wall 20 of the housing 12, and preferably is interposed between the two small walking plates 84. The terminal block box 90 is rectangular in shape and extends outward from the top wall 20 to define a hollow area within the terminal block box 90. Electrical devices are contained within the terminal block box 90 for the electrical control of the fan motor 62. The terminal block box 90 may be mounted on the top wall 20 using conventional attaching means such as screws or bolts. Alternatively, the terminal block box 90 may be welded or riveted to the top wall 20.

In operation, the fan unit 10 is positioned so that the aperture 30 on the top wall 20 is in communication with an area outside the walls of the clean room. The filter 72 is positioned so that the filter 72 communicates with the area within the clean room. The fan motor 62 rotates drive shaft 60 to rotate and drive the fan 42. The rotation of the fan 42 then draws air into the aperture 30 of the housing 12 from an area outside the clean room. The air enters the hollow area within the fan 42 and then flows out of the fan 42 and into the cavity 22 through the slots 49 between the fan blades 48. As discussed, the pitch angle of the fan blades 48 is selected to cause the air to flow in a direction away from the vertical axis 46 and towards the side and end walls 14 and 16 and against sound deadening baffles 76.

The operation of the fan 42 creates a high pressure in the cavity 22 that forces the air through the perforations 70 in the plate 66 and into the plenum 74 in a direction substantially parallel to the vertical axis 46. The perforations 70 diffuse the air as it flows through the plate so that the air flows in a laminar state into the plenum 74. The plate 66 also shields the air in plenum 74 from the turbulence in the cavity 22. The air guide 67 blocks air from being sucked into the fan unit from below the motor 62. While not required, preferably the air guide 67 is slightly tapered into the "V" shape previously described so that it urges the air underneath the motor 62 toward the filter 72.

Because of the high pressure in cavity 22, the air within the plenum 74, is continuously forced out of the plenum 74, through the filter 72 and into the clean room. As the air passes through the filter 72, the filter 72 traps particles and other impurities that would otherwise pass into the clean room. Thus, the clean room fan unit 10 may be used to supply a continuous flow of air into a clean room, where the air flow is substantially free of undesired contaminants and particles.

The pitch angle of the blades 48 is preferably selected to move the air in the most efficient manner possible for a given speed of motor 62. The motor 62 is advantageously a 6 pole, 208 volt, 60 hz. 200 watt motor. The voltage can vary about 16 volts higher or lower, so the motor 62 can operate on 220 volt power. The motor has a maximum rated flow rate of 640 cfm, providing an air flow of about 90 ft/min. The motor 62 is advantageously a three speed motor with low speed being about 882 rpm at 0.62 amps and 125 watts, the medium speed being about 1017 rpm at 0.65 amps and 135 watts, and the high speed being at about 1127 rpm at about 0.75 amps and 165 watts. The speed can vary by about 50 rpm up or down. The total shaft run-out on the motor is advantageously lower than 0.00197 inches, to reduce vibration of the fan unit.

There are a number of advantages associated with the clean room fan unit of the present invention. The fan 42 has fan blades 48 that have a pitch angle selected and optimized to provide a predetermined flow rate for the selected motor power and rotational to increase the efficiency of the fan unit 10. The baffles 76 that are positioned on the end walls 16 advantageously reduce the amount of noise generated by the clean room fan unit 10. Furthermore, bell mouth 26 increases efficiency and reduces noise by assisting laminar flow of air into the fan 42. The perforated plate 66 that extends across the cavity 22 has a series of perforations 70 that advantageously diffuse the air flow and cause laminar air flow through the plate 66 in order to reduce turbulence, as well as reducing vibration and noise.

The plenum 74 further reduces turbulence and helps distribute air flow through the entire filter 72 to further reduce noise while ensuring efficient performance of the fan filter unit. Advantageously the plenum 74 is formed by having the filter 72 spaced apart from the perforated plate 66 by about 2 inches (5 cm), or about ⅕ the 10–11 inch height of the fan unit 10, and about ¼ the height of the cavity 22 between the top wall 20 and perforated plate 66. The clean room fan unit 10 produces clean air more quietly and more efficiently than prior units.

Advantageously, at least one of the air guide or motor mounting plate blocks air in the cavity from flowing along the motor toward the bell mouth. In the preferred embodiment, the air guide 67 provides such blockage and does so along a width slightly greater than the motor width and for a strip extending the distance between opposing sides 14. Preferably the width of the air guide 67 is about 10 inches (25 cm), or about ⅕ the 45 inch length of fan unit 10.

There is thus advantageously provided a bell mouth 26 configured to reduce noise and improve operating efficiency of the fan 42 with which the bell mouth 26 is in fluid communication. The fan 42 is configured relative to the motor 62 and the desired flow rate so the blades 48 are at an optimum pitch angle to efficiently and quietly move the air from the fan 42 into the cavity 22, and to pressurize that cavity. The motor support 64 and air guide 67 prevent air from exiting the cavity 22 and thus improve the efficiency of the unit and reduce noise by reducing the turbulence that would be caused from air entering the fan 42 from around and below the motor 62. The pressurized cavity 22 is lined with sound absorbing material 76 to the sound. The air is forced through the perforated plate 66 which induces quiet, laminar flow into the plenum chamber 74. The plenum 74 allows air to flow below the entire surface of the perforated plate 66 and thus ensures air flow through the entire filter 72, including the area below motor 62. The air exits the filter 72 into the clean room for efficient, and quiet flow through the room to remove particles from the room.

Preferably the fan unit 10 is made of aluminum wherever possible, and thus except for the motor 62 and filter 72, is advantageously made of aluminum. Further, the various parts forming the cavity 22 are advantageously rived or spot welded where possible to maintain an air tight enclosure.

Figure 9:
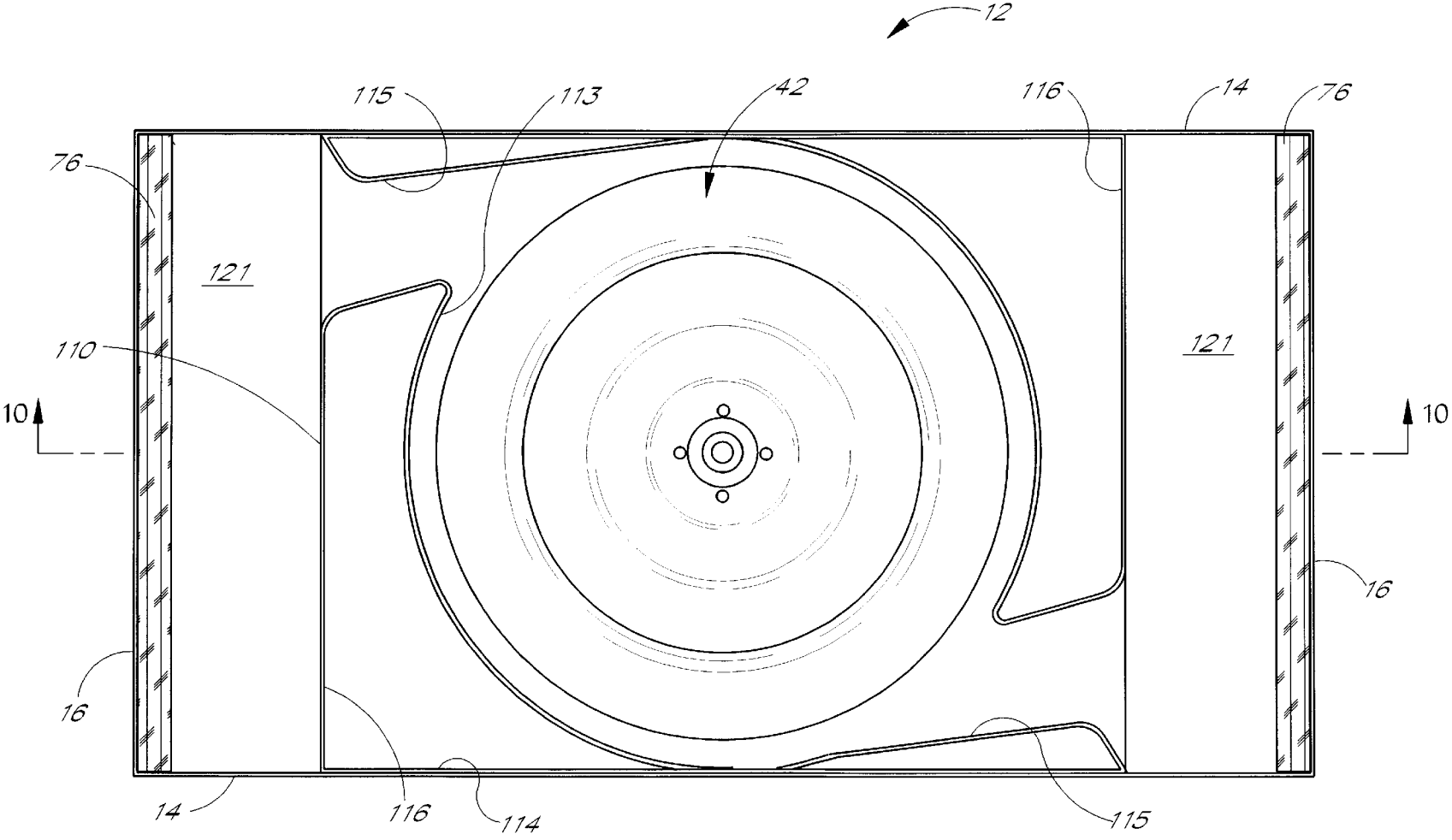
FIG. 9 is a simplified cross-sectional view of an alternate embodiment of this invention taken along 9—9 of FIG. 10.
Figure 10:
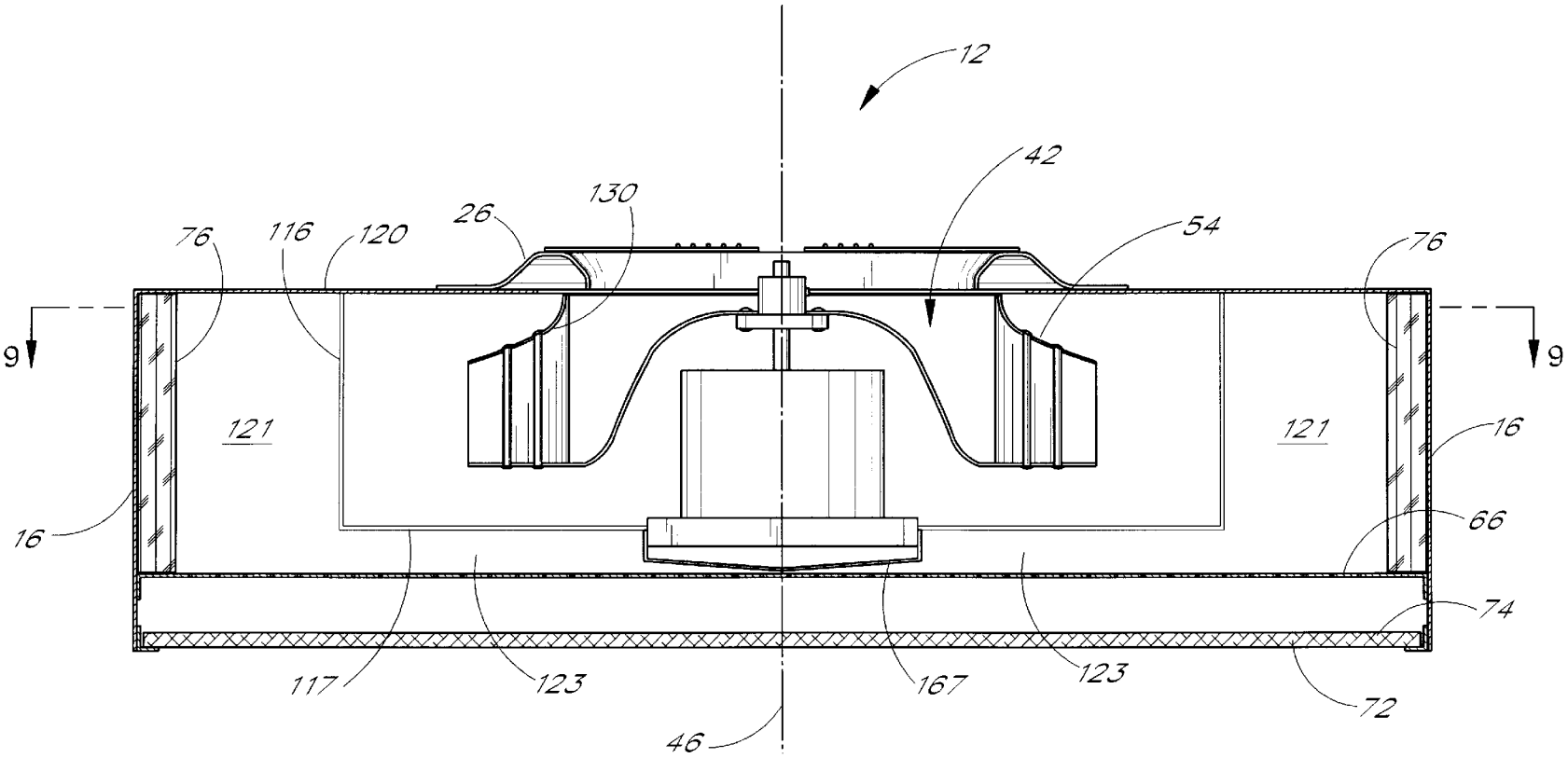
FIG. 10 is a simplified cross-sectional view of the alternate embodiment of this invention taken along 10—10 of FIG. 9

Referring to FIGS. 9–10, a still further embodiment is described in which like numbers refer to previously described parts. The fan unit 42 is placed inside a smaller rectangular housing 112 having opposing, substantially parallel sides 114 and ends 116, with the sides 114 configured to just fit inside, and possibly connect to, the sides 14. A rectangular top 120 connects to the sides 114 and ends 116. The sides 114 are about 30 inches (76 cm) long, leaving a space of about 8–9 inches (20–23 cm) between each of the ends 116 of housing 112 and the corresponding ends 16 of housing 12. Thus, end cavities 121 are formed between the ends of housing 12 and housing 112. Sound absorbing material, such as baffles 76, are connected to the ends 16 as previously described. The housing 112 has a bottom 117 riveted, welded, or otherwise fastened to sides 114 and ends 116. The top 120 and bottom 117 are about six inches (15 cm) apart.

A hole 130 is placed in top 120, with bell mouth 26 surrounding the hole. A fan 42 is mounted to the housing 112 in a manner previously described relative to housing 12. The housing 112 has a generally annular cavity 113 surrounding the periphery of fan 42, with the walls of the cavity 113 being generally spaced about 1–2 inches (2–5 cm) from the periphery of fan 42. Tunnels 115 extend generally tangentially from the location of the fan 42 adjacent the side walls 114, toward the end walls 116. The tunnels 115 expand in area as they approach the end walls 114 to accommodate the expansion of the air as it leaves the fan 42. The air from the fan 42 hits the baffles 76 on walls 16 and creates a turbulent flow of high pressure air.

A motor 62 is drivingly connected to rotate the fan 42 as previously described. Motor 62 is mounted to a support bracket such as support plate 164 which is configured as support plate 64, except plate 164 located outside the bottom 117 to connect to side walls 14. An air guide 167 is configured to correspond in shape to air guide 67 previously described, and is mounted to support plate 164 outside of the bottom 117 of housing 112. The distal portion of the air guide 167 is about 1.75 inches (4.5 cm) from the bottom 117 and extends away from bottom 117 and motor 62.

A perforated plate 66 is mounted to side walls 14 and end walls 16 as previously described. The distal portion of air guide 167 is closely adjacent to, or abuts, the perforated plate 66 at about the middle of the plate 66 along a plane passing through the rotational axis 46 of the fan 42. Thus, flat, rectangular cavities 123 are formed between the perforated plate 66 and the adjacent portions of housing 112 on opposing sides of the air guide 167. A plenum 74 is formed below the perforated plate 66 as previously described, and a filter 72 is located below the plenum 74.

In this embodiment, the fan 42 rotates inside the annular cavity 113 with the tunnels 115 delivering the air into cavities 121 and toward the ends 116 creating a high pressure and turbulent flow in cavities 121 and 123. The perforated plate 66 smooths out the turbulent flow as the high pressure forces the air through plate 66 into plenum 74. The plate 66 also shields the air beneath the fan 42 in plenum 74 from the turbulence in the cavities 121, 123. The air guide 167 delivers the high pressure air into the plenum 74 through perforated plate 66, and also separates the cavities 123. The plenum 74 allows air to access the entire surface of filter 72, and further smooths out the flow of the air.

This alternate embodiment advantageously uses the laminar flow of air through bell mouth 26 to reduce noise and improve the efficiency of the fan 42, but further delivers the air from the fan directly against the walls 16 and baffles 76 to create a turbulent air in the cavities 121, 123. Because the housing 112 is inside the housing 12, the volume of cavities 121, 123 is less than the volume of cavity 22 (FIG. 2), so that the pressure is increased. Thus, this alternate embodiment creates turbulent flow in a more confined space creating higher pressure, and more turbulent air, in cavities 121, 123. The cavity 123 enables this turbulent air to enter substantially the entire surface of perforated plate 66, which smooths out the turbulence, with plenum 74 further smoothing out the turbulence before the air enters the filter 72.

Although the preferred embodiment of the present invention has disclosed the features of the invention as applied to these embodiments, it will be understood that various omissions, substitutions, and changes in the form of the detail of the embodiments illustrated may be made by those skilled in the art without departing from the spirit of the present invention. Consequently, the scope of the invention should not be limited to the foregoing disclosure.

What is claimed is:

1. A clean room fan unit, comprising:

a rectangular main housing having two substantially parallel side walls joined to two substantially parallel end walls and further having the side and end walls joined to a rectangular top wall to define a rectangular cavity, the top wall having an exterior surface and interior surface with a generally circular aperture extending through the top wall and located at the center of the top wall;

a bell mouth surrounding the aperture in the top wall and configured to cause air flowing through the aperture to enter the aperture in a laminar flow;

a fan located below the aperture and inside the rectangular cavity and in fluid communication with the bell mouth, the fan rotating about a longitudinal axis that passes through the center of the aperture to take incoming air from the bell mouth and expel the air into the cavity in a plane generally perpendicular to the rotational axis, the fan having a plurality of fan blades mounted between top and bottom support surfaces, the blades having an airfoil cross-sectional shape and mounted a uniform distance from the rotational axis and orientated at a pitch angle selected to move air efficiently at a predetermined rotational speed of the fan;

a fan motor inside the cavity and drivingly connected to the fan to rotate the fan about the axis at a predetermined speed;

a motor mounting plate extending between the side walls and connected to the motor to support the motor in the cavity;

an air guide plate below the motor and extending between the side walls, the air guide plate having a longitudinal center line and edges and being angled along the center line so the center line of the air guide plate is further from the motor than the edges, at least one of the air guide or motor mounting plate blocking air in the cavity from flowing along the motor toward the bell mouth;

a perforated plate below the air guide plate, the perforated plate being connected to the side and end walls to enclose the cavity so the fan can create a high pressure within the cavity and force air through the perforated plate;

a mounting bracket connected to at least one of the end or side walls for mounting a filter within the end and side walls such that the filter is below and spaced apart from the perforated plate to define a plenum above the filter to allow air flowing through the perforated plate to be distributed below the entire surface of the perforated plate.

2. The clean room fan unit as defined in claim 1, wherein the filter comprises one of a HEPA or ULPA filter supported by the bracket and wherein the plenum allows air to enter the surface of the filter that faces the perforated plate.

3. The clean room fan unit as defined in claim 1, wherein the air guide plate is connected to the motor mounting plate to further support the motor.

4. The clean room fan unit as defined in claim 1, wherein the pitch angle of the fan blades and the motor windings are cooperatively configured to provide a predetermined flow rate of air yet minimize the power required by the motor and the noise generated by operation of the fan.

5. The clean room fan unit as defined in claim 1, wherein the air guide plate is angled about 5–9 degrees.

6. The clean room fan unit as defined in claim 5, wherein the fan unit has a length and the air guide plate has a width about ⅕ the length of the fan unit and serves to block air from flowing along the motor toward the rotational axis of the fan.

7. The clean room fan unit as defined in claim 1, wherein the height of the plenum is about ¼ the distance between the top and the perforated plate.

8. The clean room fan unit as defined in claim 1, wherein at least one of the end walls and side walls has sound absorbing material on it.

9. A clean room fan unit, comprising:

a rectangular main housing having side walls, end walls and a top with a circular hole through it, a structure surrounding the hole configured to impart a laminar flow to air entering the hole during operation of the fan unit, at least one of the walls having a baffle to reduce noise, and a filter opposite the top defining a main cavity between the top and the filter surrounded by the side and end walls;

a subhousing having side walls and end walls defining a subcavity therein, the subhousing being located in the main cavity and in fluid communication with the hole;

a squirrel cage fan positioned within the subcavity of the subhousing and below the hole for drawing air into the subhousing through the hole and along a rotational axis generally orthogonal to the top, the fan exhausting the air into the main cavity through the subcavity against at least the one wall having a baffle on it;

at least one tunnel defining a flow path between the subcavity and the main cavity for the flow of air from the fan unit into the main cavity, the tunnel expanding as the tunnel approaches the main cavity;

a perforated plate interposed between the fan and the filter to deliver the flow of air to the filter and defining a plenum between the filter and the perforated plate to allow air flow over the entire surface of the filter; and an air guide plate extending between the side walls and interposed between the fan and the perforated plate to deliver air toward the filter.

10. The clean room fan unit as defined in claim 9, wherein the fan unit has a length and the air guide plate has a width about ⅕ the length of the fan unit and serves to block air from flowing along the motor toward the rotational axis of the fan.

11. The clean room fan unit as defined in claim 9, wherein the height of the plenum is about ¼ the distance between the top and the perforated plate.

12. A clean room fan unit, comprising:

a main housing having sides and a top with a hole in it that is surrounded by a bell mouth configured to induce laminar flow to the air flowing through the hole, the main housing having a bottom formed by a filter;

a subhousing within the main housing, the subhousing defining a subcavity therein and an end cavity between the subhousing and the main housing;

a fan surrounded by the subhousing and in fluid communication with the hole for pressurizing the main housing and the subhousing;

at least one tunnel defining an expanding air flow path between the subcavity and the end cavity;

perforated means interposed between the fan and the filter for imparting laminar flow to air passing through the perforated means and for distributing pressurized air over the entire surface of the filter; and air guide means interposed between the fan and the perforated means for delivering air to the filter.

13. The clean room fan unit as defined in claim 12, wherein the fan unit has a length and the air guide means comprises a plate has a width about ⅕ the length of the fan unit and further serves to block air from flowing along the motor toward the rotational axis of the fan.

14. The clean room fan unit as defined in claim 12, wherein the plenum means has a substantially uniform height that is about ¼ the distance between the top and the perforated means.

15. The clean room fan unit as defined in claim 9, wherein the filter comprises one of a HEPA or ULPA filter.

16. The clean room fan unit as defined in claim 12, wherein at least one of the sides of the main housing has sound absorbing material on it.

17. The clean room fan unit as defined in claim 1, additionally comprising a subhousing surrounding the fan and being located within the rectangular cavity defined by the rectangular housing, the subhousing defining an end cavity between the subhousing and the end walls of the main housing.

18. The clean room fan unit as defined in claim 17, wherein the subhousing includes an annular wall disposed around the periphery of the fan, the annular wall defining an annular cavity surrounding the periphery of the fan, and wherein the annular cavity is in fluid communication with the end cavity.

19. The clean room fan unit as defined in claim 18, wherein the annular wall is generally spaced about 1–2 inches from the periphery of an adjacent one of said side and end walls.

20. The clean room fan unit as defined in claim 18, additionally comprising at least one tunnel connecting the annular cavity with the end cavity, the tunnel defining a flow path for air flow from the fan to the end cavity.

21. The clean room fan unit as defined in claim 20, wherein the flow path defined by the at least one tunnel expands in size as at least one the tunnel approaches the end cavity.

22. The clean room fan unit as defined in claim 9, wherein the subhousing includes an annular wall surrounding the periphery of the fan, and wherein the subcavity comprises an annular cavity defined between the annular wall and the periphery of the fan.

23. The clean room fan unit as define in claim 9, wherein the at least one tunnel extends from the location of the fan toward one of the end walls of the main housing.

24. The clean room fan unit as defined in claim 12, additionally comprising a wall surrounding the fan, the wall defining an annular cavity around the periphery of the fan.

25. The clean room fan unit as defined in claim 12, wherein the at least one tunnel connects the annular cavity to the end cavity.

26. The clean room fan unit as defined in claim 1, wherein at least one tunnel extends generally tangentially from a periphery of the fan toward one end wall of the main cavity.

27. The clean room fan unit as defined in claim 1, further comprising a first tunnel extending from a first side of the fan in a direction generally tangential from the fan adjacent the side wall toward one end wall of the main cavity, and a second tunnel extending from an opposing side of the fan in a direction generally tangential from the fan toward the other end wall of the main cavity.

28. The clean room fan unit as defined in claim 9, wherein the at least one tunnel extends generally tangentially from a periphery of the fan toward one end wall of the main cavity.

29. The clean room fan unit as defined in claim 9, wherein the at least one tunnel comprises a first tunnel extending from a first side of the fan in a direction generally tangential from the fan adjacent the side wall toward one end wall of the main cavity, and a second tunnel extending from an opposing side of the fan in a direction generally tangential from the fan toward the other end wall of the main cavity.

30. The clean room fan unit as defined in claim 12, wherein the tunnel extends generally tangentially from a periphery of the fan toward one end wall of the main cavity.

31. The clean room fan unit as defined in claim 12, wherein the at least one tunnel extends generally tangentially from a periphery of the fan toward one end wall of the main cavity.

32. A clean room fan unit, comprising:

a rectangular main housing having side walls, first and second end walls and a top with a circular hole through it, a structure surrounding the hole configured to impart a laminar flow to air entering the hole during operation of the fan unit, at least one of the walls having a baffle to reduce noise, and a filter opposite the top defining a main cavity between the top and the filter surrounded by the side and end walls;

a radial fan positioned within the cavity and enclosed by a fan housing that is in fluid communication with the hole and along a rotational axis of the fan and generally orthogonal to the top of the main housing, the fan exhausting the air through a first tunnel that extends in a generally tangential direction from the fan toward the first end wall and through a second tunnel that extends in a generally tangential direction from the fan toward the second end wall, the tunnels expanding as they approach the end wall;

a perforated plate interposed between the fan and the filter to deliver the flow of air to the filter and defining a plenum between the filter and the perforated plate to allow air flow over the entire surface of the filter; and an air guide plate extending between the side walls and interposed between the fan and the perforated plate to deliver air toward the filter.

* * * * *